US006006364A

United States Patent [19]

Newsom et al.

[11] Patent Number: 6,006,364

[45] Date of Patent: Dec. 28, 1999

[54] SUPPORT DEVICE FOR CLOTHING SHOULDER STRAPS

[76] Inventors: Janice M. Newsom, 11792 Woodside Ln, Jacksonville, Fla. 32223; Jeanine M. Wells, 520 Golden Pond Ct, Jacksonville, Fla. 32259

[21] Appl. No.: 08/630,154

[22] Filed: Apr. 10, 1996

[51] Int. Cl.[6] ..... A41D 27/10

[52] U.S. Cl. ..... 2/323; 2/338; 450/86

[58] Field of Search ..... 2/323, 310, 311, 2/312, 325, 336; 450/86, 88

[56] References Cited

U.S. PATENT DOCUMENTS

| | | | |
|---|---|---|---|
| 1,401,227 | 12/1921 | Wyeth | 2/323 |
| 1,648,776 | 11/1927 | McOrin | 2/323 |
| 1,782,057 | 11/1930 | Bollinger | 2/323 |

OTHER PUBLICATIONS

Gershman, Maurice, "Slef–Adhering Nylon Tapes." The J.A.M. A., vol. 168, No. 7, p. 930, Oct. 1958.

*Primary Examiner*—Gloria Hale

[57] ABSTRACT

A stretchable, adjustable support device for clothing shoulder straps which connects together straps worn near opposite shoulders and biases shoulder straps worn near one shoulder toward those straps worn near the opposite shoulder to maintain each in a centrally located position between the wearer's neck and one of the wearer's shoulders, thus preventing the straps worn near either shoulder from sliding over its adjacent shoulder. The ends of the support device may be connected to the shoulder straps with hook and pile types of fasteners or they may be permanently attached to the shoulder straps. Applications may include, but are not limited to, use in supporting straps of brassieres, slips, camisoles, and swimsuits.

9 Claims, 3 Drawing Sheets

SUPPORT DEVICE FOR CLOTHING SHOULDER STRAPS

BACKGROUND

1. Field of Invention

This invention relates to devices for interconnecting two objects and biasing each toward the other, specifically to a stretchable, adjustable support device for clothing shoulder straps which connects straps on opposite shoulders together and maintains them in a centrally located position between the wearer's neck and shoulders, thus preventing the straps from sliding over the wearer's shoulders. Applications may include, but are not limited to, use in supporting straps of brassieres, slips, camisoles, and swimsuits.

2. Description of Prior Art

It is known for persons wearing clothing with shoulder straps to occasionally have problems with the shoulder straps becoming loosened and sliding over that person's shoulders. The shoulder straps could become loosened if the garment having the shoulder straps is ill-fitting to the person wearing it. The shoulder straps could also become loosened if the person is wearing outer clothing having a waistband which allows the garment to slide upward when the person's arms are raised to an overhead position, but which fails to allow the garment to slide downward into its former position when the person's arms are lowered. The shoulder straps could also become loosened on a garment used for swimming, should its material stretch as it becomes wet. This is a recurring problem for people wearing garments with shoulder straps, a problem for which no successful solution has been found to date. The choice of not wearing clothing with shoulder straps is not a viable solution for most people, as most clothing with shoulder straps are fundamental articles of clothing, such as swimsuits, brassieres, and slips, and although alternative clothing is sometimes available, it is usually special purpose clothing which is more expensive and not always comfortable for everyday use.

If a person is wearing outer clothing over the garment having shoulder straps, at the very least, the sliding of shoulder straps over a shoulder becomes distracting, and may be uncomfortable in restricting movement of the shoulder and adjacent upper arm. Should the person attempt to remedy the situation by reaching inside the outer clothing to re-adjust the shoulder straps into their proper positions, it could become embarrassing for that person if seen doing so. Also, if the person is wearing outer clothing which is sleeveless over the garment with shoulder straps, or no outer clothing over it, the mere sliding of shoulder straps over the person's shoulder could cause a fundamental failure in the function of the garment and be embarrassing for both the person wearing the garment and others within view. Further, it is generally held to be unacceptable social behavior to display undergarments in public, even if such display is the mere sliding of an undergarment shoulder strap from beneath a sleeveless blouse and partially over a shoulder so that it is in general view by others.

It has been known for people wearing multiple garments, each having shoulder straps, to use small clipping devices for attaching together shoulder straps which are grouped together adjacent to the same shoulder, such as the shoulder straps belonging to a brassiere and a slip. A disadvantage of such clipping devices is that two or more garments having shoulder straps must be worn simultaneously by the person to allow their use. Such clips would not be functional when the shoulder straps of a single garment become loose enough to fall over a shoulder, which often happens. Also, such clipping devices would not necessarily prevent clipped shoulder straps from sliding over the shoulder of the wearer when the person is wearing outer clothing having a waistband, such as the waistband of a skirt, which allows the garments to slide upward when the person's arms are raised to an overhead position, but which fails to allow the garments to slide downward when the person's arms are lowered.

It is also known for people to use an elongated piece of elastic for encircling both shoulder straps of an article of clothing and connection means, such as a hooking device, to connect the elastic into a closed loop, the connection means being centrally located behind the wearer's back. One disadvantage of using such a piece of elastic and connection means is that most wearers, while wearing the garment having shoulder straps, are unable to form the elastic into a closed loop around the shoulder straps to bias the clothing shoulder straps toward each other and require help from another person in doing so. Also, such a biasing means is not adjustable. It is also known to have adjustable elastic means for connection between shoulder straps on an article of clothing which have a double-slotted end bracket on each of its ends for insertion therethrough of one of the clothing shoulder straps. Disadvantages of the adjustable elastic means is that its end brackets only allow insertion of small clothing straps, it is difficult to insert the end straps securely into the slots in each end bracket, and the clothing straps are known to become easily detached from such end straps. None of the known prior art devices has successfully solved the problems encountered with shoulder straps which have been described herein. It would therefore be useful, and it is not known, to have a support device for clothing shoulder straps which connects straps on opposite shoulders together and biases them toward each other to maintain them in a centrally located position between the wearer's neck and shoulders, thus preventing the straps from sliding over the wearer's shoulders. Such a support device would also be useful in solving another problem encountered by people wearing garments having shoulder straps. After extended wear some people wearing garments having shoulder straps experience a rubbing or binding of the shoulder straps against the same area of skin between the wearer's neck and shoulders, causing discomfort to the wearer. It would be useful to have a vertically adjustable support device by which to bias shoulder straps toward one another so that during extended wear the support device could be periodically adjusted for positioning of the shoulder straps across different areas of skin between the wearer's neck and shoulders.

SUMMARY OF INVENTION

Objects and Advantages

It is the primary object of this invention to provide a shoulder strap support device which would prevent loose undergarment clothing straps from sliding over a wearer's shoulders. It is also an object of this invention to provide a shoulder strap support device which would prevent swimsuit straps from sliding over a wearer's shoulders should they loosen after becoming wet. A further object of this invention is to provide a shoulder strap support device which may be permanently attached to clothing shoulder straps, or releasably attached thereto. It is also an object of this invention to provide a shoulder strap support device which may be vertically and horizontally adjustable for use by persons of different heights and girths. A further object of this invention is to provide a shoulder strap support device which is adjustable in length. It is also an object of this invention to provide a shoulder strap support device which securely attaches to the shoulder straps of clothing and stays attached thereto during use. A further object of this invention is to provide a shoulder strap support device which a wearer is able to attach to the shoulder straps of clothing being worn without help from another person. It is also an object of this invention to provide a shoulder strap support device which attaches to many different sizes and designs of garments.

As described herein, properly manufactured and connected to the straps of at least one article of clothing, the present invention would provide a support device for clothing shoulder straps which connects straps on opposite shoulders to one another. Since the present invention is made of stretchable material, it biases straps on opposite shoulders toward each other to maintain each set of straps in a centrally located position between the wearer's neck and one shoulder, thus preventing any of the straps from sliding over an adjacent shoulder. The present invention may comprise hook and pile type of fasteners, such as "VELCRO", to allow the present invention to be readily detachable from the garments to which it is attached, after use. Such fasteners would also allow the present invention to attach to straps from more than one garment at a time. In the alternative, the present invention may be stitched directly to one, or both, of the shoulder straps on one garment for use only with that garment. Both the hook and pile type of fasteners and direct stitching securely attach the present invention to the shoulder straps of a article of clothing during use. A length of non-stretchable material, such as satin ribbon, a cotton material, or other materials, may be attached to one or both ends of the stretchable material for use in attaching the hook and pile fasteners to the stretchable material for a more stable gripping of the present invention to garment straps. A connecting bracket is used between each length of stretchable and non-stretchable material. Since the present invention biases straps on opposite shoulders toward one another, the present invention would be equally effective in keeping undergarment straps, as well as wet swim suit straps, from falling over the wearer's shoulders. The present invention may be may made from materials of different colors to blend with, or provide an accent to, the colors of the swim suit material. When the present invention is made to be releasably detachable, the present invention may be attached to opposite shoulder straps of a garment, then slid vertically or horizontally to adjust to the comfort of the wearer. The vertical adjustability also makes the present invention helpful in preventing shoulder straps from binding into the same area of skin between the wearer's neck and shoulders during extended wear of a garment having shoulder straps. The stretchable material is also adjustable in length, being inserted twice through an adjusting bracket and stitched to itself so that the portion of the stretchable material for use in lengthening the present invention is folded behind the remainder of the stretchable material. As a result, the adjusting bracket may be moved laterally between the straps to lengthen and shorten the amount of stretchable material folded behind the remainder of the stretchable material. The present invention fits many sizes and styles of garments and is easy to install and remove so that a wearer may attach and detach the present invention without assistance from another person.

The description herein provides preferred embodiments of the present invention but should not be construed as limiting the scope of the clothing shoulder strap support invention. Variations in the type of stretchable material used, the type of non-stretchable material used, the length and width of the stretchable and non-stretchable materials used, type of adjusting brackets used, the type of connecting brackets used, the material from which the adjusting brackets and connecting brackets are made, and the means for permanently attaching the ends of the invention to the shoulder straps of an article of clothing, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
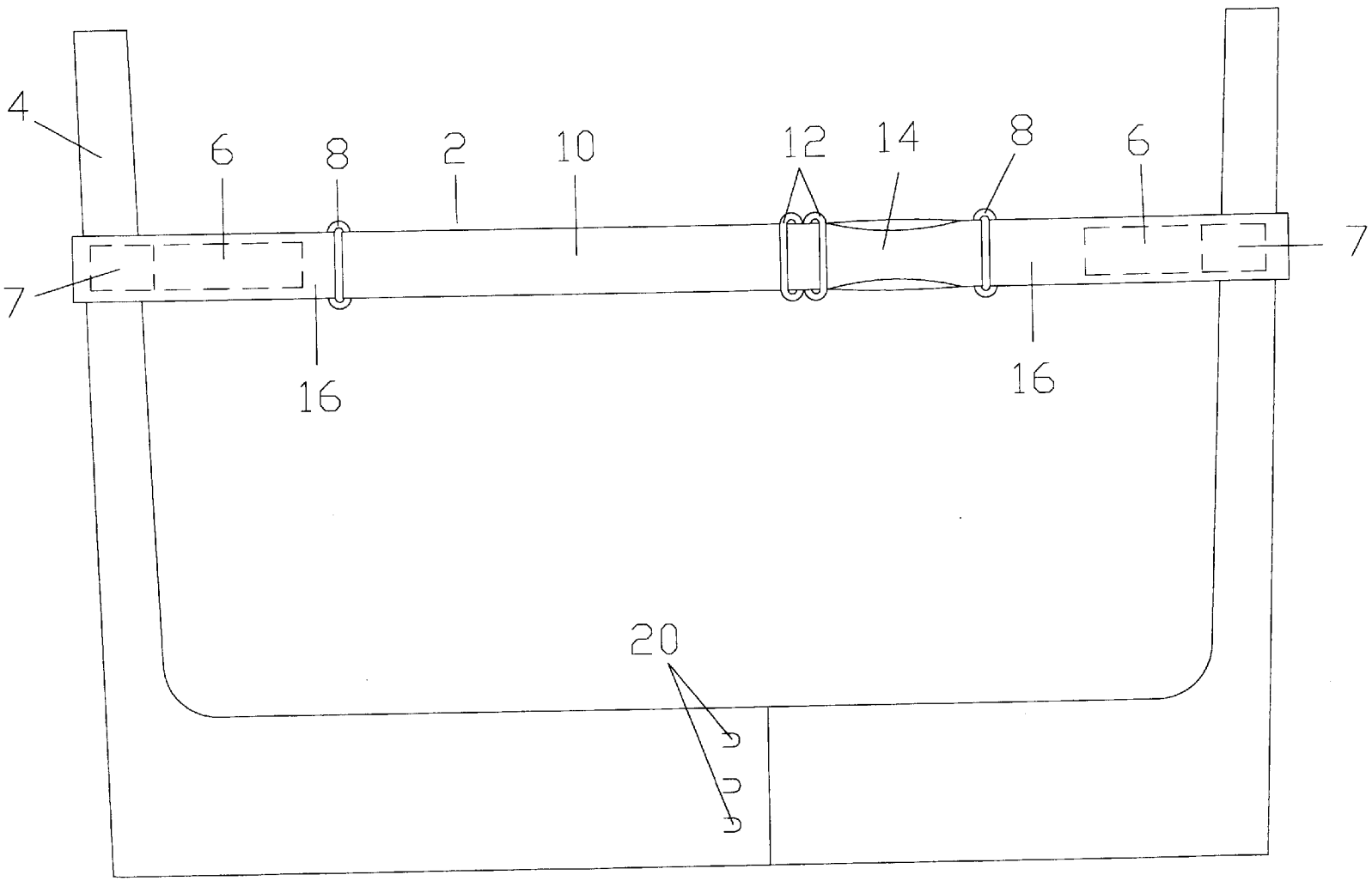
FIG. 1 is a perspective view of the invention releasably attached to each shoulder strap of an article of clothing having two shoulder straps.

FIG. 1 shows a first preferred embodiment of a shoulder strap support invention 2 detachably connected to both sides of the back of an article of clothing having shoulder straps 4 and also having fastening devices 20 positioned on a back portion of material between the lower portions of shoulder straps 4. FIG. 1 shows shoulder strap support invention 2 having a length of stretchable material 10 attached between the central openings of two connecting brackets 8. Although not shown in detail in FIG. 1, it is contemplated for one end of stretchable material 10 to be inserted through the central opening of one connecting bracket 8 and be secured to itself close thereby to that same connecting bracket 8, and for the other end of stretchable material 10 to be inserted through both apertures in an adjusting bracket 12, then inserted through the central opening in the second connecting bracket 8, folded around adjusting bracket 12 to be inserted through both apertures in adjusting bracket 12 in the same direction as the first insertion of stretchable material 10 through adjusting bracket 12, and then finally secured to itself adjacent to its end and close thereby to adjusting bracket 12 so that the middle portion of stretchable material 10 remains movable through adjusting bracket 12. Although FIG. 1 shows one adjusting bracket 12, it is contemplated for shoulder strap support invention 2 to have more than one adjusting bracket 12. FIG. 1 also shows shoulder strap support invention 2 having two non-stretchable lengths of material 16, one end of each being inserted through one connecting bracket 8 and secured to itself close thereby to its adjacent connecting bracket 8. The hook portion 7 of a hook and pile type of fastener, such as "VELCRO", is connected adjacent to the remote opposite end of each length of non-stretchable material 16, with the pile portion 6 of each hook and pile type of fastener being attached to the non-stretchable material 16 in a position adjacent to hook portion 7 and between hook portion 7 and connecting bracket 8. The remote end of each length of non-stretchable material 16 is then positioned around one shoulder strap 4, so that it encircles shoulder strap 4, and hook portion 7 is secured to its adjacent pile portion 6 to firmly attach, but temporarily attach, shoulder strap support invention 2 between shoulder straps 4. Although not shown, in the preferred embodiment it is contemplated for non-stretchable material 16 and stretchable material 10 each to be secured to itself by stitching with threaded means.

Figure 2:
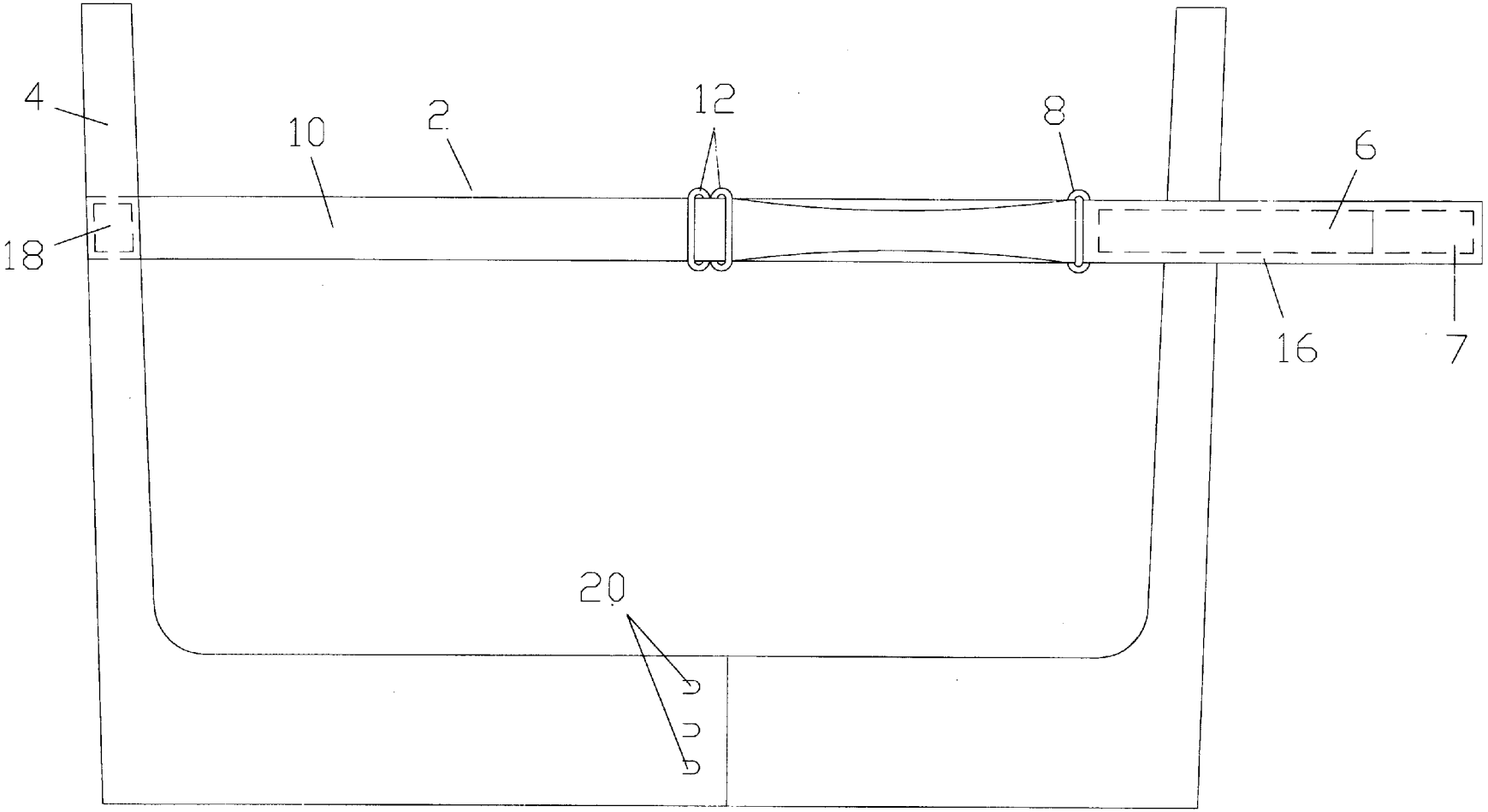
FIG. 2 is a perspective view of the invention permanently attached to one shoulder strap of an article of clothing having two shoulder straps and releasably attached to the second shoulder strap.

FIG. 2 shows a second embodiment of shoulder strap support invention 2 wherein one end of shoulder strap support invention 2 is permanently attached to one shoulder strap 4 of the back of an article of clothing having fastening devices 20 on a back portion of material between the lower shoulder straps 4, and the opposite end of shoulder strap support invention 2 is detachably connected to the other shoulder strap 4. FIG. 2 shows a first end of stretchable material 10 securely fastened to one shoulder strap 4. The second end of stretchable material 10 is inserted through both apertures in adjusting bracket 12, then inserted through the central opening in connecting bracket 8, looped around adjusting bracket 12 prior to a second insertion through both apertures in adjusting bracket 12 in the same direction as the first insertion, and finally secured to itself close thereby to the second end of stretchable material 10 and adjusting bracket 12 so that the middle portion of stretchable material 10 remains movable through adjusting bracket 12. FIG. 2 further shows shoulder strap support invention 2 having one non-stretchable length of material 16, one end of which is inserted through connecting bracket 8 and secured to itself close thereby to that same connecting bracket 8. The hook portion 7 of a hook and pile type of fastener is connected adjacent to the distal end of non-stretchable material 16, with the pile portion 6 of a hook and pile type of fastener being attached to non-stretchable material 16 in a position adjacent to hook portion 7 and between hook portion 7 and connecting bracket 8. The distal end of non-stretchable material 16 is then positioned around one shoulder strap 4, so that it encircles shoulder strap 4, and hook portion 7 is secured to its adjacent pile portion 6 to firmly, but temporarily, attach shoulder strap support invention 2 between shoulder straps 4.

Figure 3:
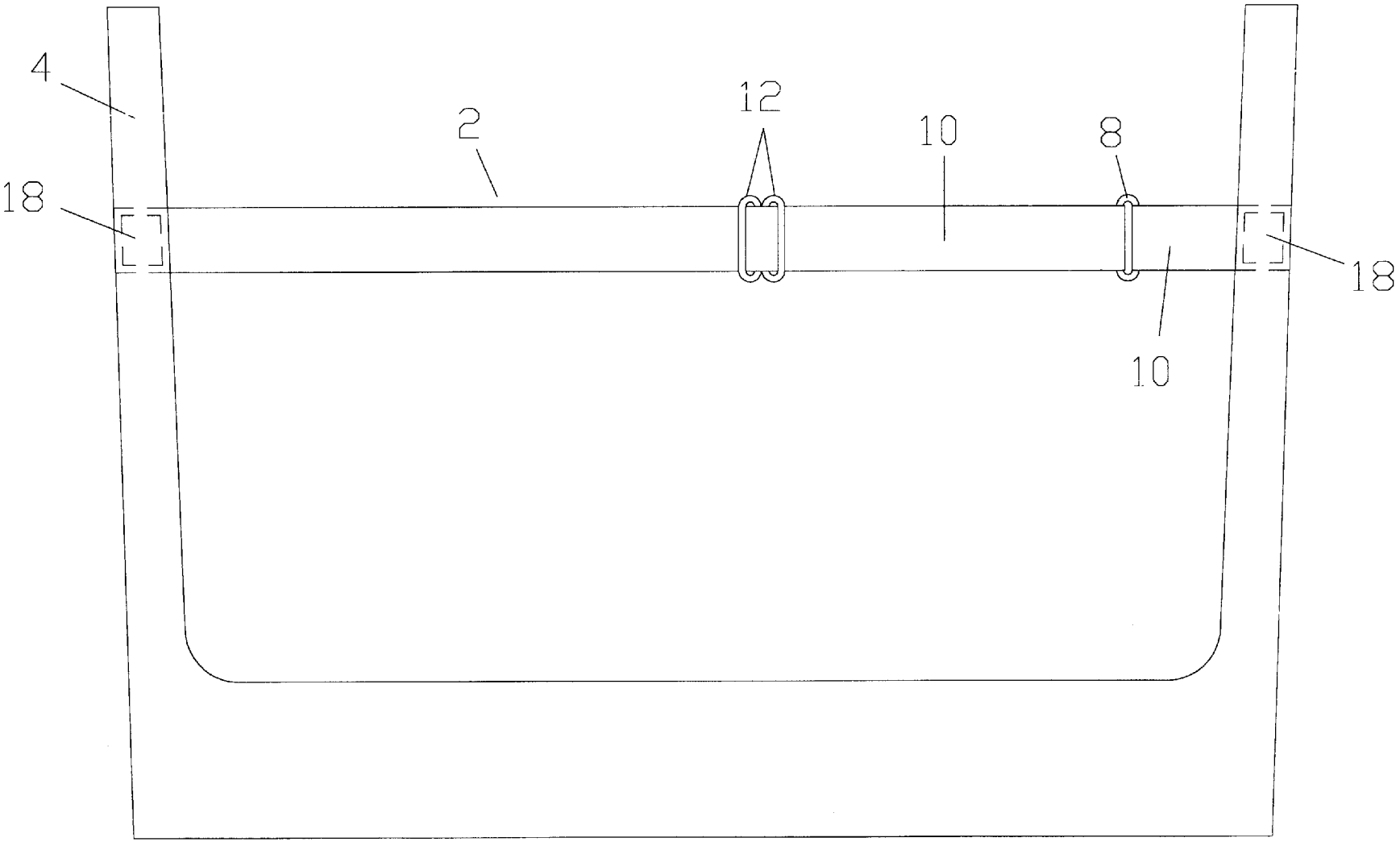
FIG. 3 is a perspective view of the invention permanently attached to each shoulder strap of an article of clothing having two shoulder straps.

FIG. 3 shows a third embodiment of shoulder strap support invention 2 wherein both ends of shoulder strap support invention 2 are permanently attached to one shoulder strap 4 of the back of an article of clothing having a portion of material between shoulder straps 4 which comprises no fastening devices 20 or has fastening means (not shown) on the front of the article of clothing (not shown). FIG. 3 shows shoulder strap support invention 2 having two lengths of stretchable material 10. One end of the first length of stretchable material 10 is permanently attached to one shoulder strap 4, with its other end inserted through the central opening of one connecting bracket 8 and secured to itself close thereby to that first end and its adjacent connecting bracket 8. FIG. 3 also shows one end of the second length of stretchable material 10 being permanently attached to one shoulder strap 4, with its other end inserted through both apertures in an adjusting bracket 12, then inserted through the central opening in the second connecting bracket 8, looped around adjusting bracket 12 and inserted in the same direction through both apertures in adjusting bracket 12 as the first insertion, and finally secured to itself close thereby to its end and to adjusting bracket 12 so that the middle portion of the second length of stretchable material 10 is movable through adjusting bracket 12.

To use the embodiment of shoulder strap support invention 2 having at least one hook portion 7 and at least one pile 6 on each end, the wearer (not shown) would first put on at least one article of clothing having shoulder straps 4 near each of the wearer's shoulders (not shown). After encircling hook portion 7 on one end of shoulder strap support invention 2 around shoulder straps 4 which are near to the wearer's first shoulder, the wearer would press one hook portion 7 against adjacent pile portion 6 to engage and firmly connect hook portion 7 to pile portion 6. Such engagement of hook portion 7 to pile portion 6 would position one of the ends of shoulder strap support invention 2 securely around shoulder straps 4 which are near to the wearer's first shoulder. Hook portion 7 may be threaded under or over shoulder strap 4 prior to becoming attached to pile portion 6. The opposite, free end of shoulder strap support invention 2 would then brought behind the wearer's head (not shown) and positioned adjacent to shoulder straps 4 which are near to the wearer's second shoulder. The wearer would then encircle hook portion 7 of the free end of shoulder strap support invention 2 around shoulder straps 4 which are near to the wearer's second shoulder and press hook portion 7 against adjacent pile portion 6 for engagement and firm connection of hook portion 7 to pile portion 6. The wearer may then move shoulder strap support invention 2 vertically along shoulder straps 4 to place stretchable material 10 into a position most comfortable to the wearer (not shown), or most appropriate to any outer garments (not shown) to be worn by the wearer over the present invention and the garment to which it is attached. Also, the wearer may adjust the length of stretchable material 10 by laterally sliding adjusting bracket 12 back and forth along the length of stretchable material 10 until a comfortable and serviceable length is found. In the alternative, one or both of the ends of present invention may be permanently stitched, or otherwise permanently affixed, to shoulder straps 4 of an article of clothing. In such an instance, the wearer would put on the article of clothing and laterally adjust the length of stretchable material 10 by sliding adjusting bracket 12 back and forth along the length of stretchable material 10 until a comfortable and serviceable length is found.

In the preferred embodiment stretchable material 10 comprises elastic and is approximately nine inches in length. Although not critical, FIGS. 1, 2, and 3 show the width of stretchable material 10 is similar to that of shoulder straps 4. However, in the preferred embodiment it is contemplated for stretchable material 10 to be narrower for use with narrow shoulder straps 4 and wider when used with wide shoulder straps 4. Also, although connecting brackets 8 may be made of other materials and have other shapes, in the preferred embodiment it is contemplated for connecting brackets 8 to be elongated plastic loops or plastic rings. Further, in the same manner, although adjusting brackets 12 may be made of other materials and have other shapes, in the preferred embodiment it is contemplated for adjusting brackets 12 to be elongated plastic loops having two adjacent openings. Also, although the material and length of non-stretchable material 16 is not critical to the present invention, in the preferred embodiment it is contemplated for non-stretchable material 16 to comprise satin ribbon and be approximately three and one-half inches in length. Although not critical, FIGS. 1, 2, and 3 show the width of non-stretchable material 16 is similar to that of shoulder straps 4. In the preferred embodiment it is contemplated for non-stretchable material 16 to be narrower for use with narrow shoulder straps 4 and wider when used with wide shoulder straps 4. Also, in connecting non-stretchable material 16 to connecting bracket 8, it is contemplated for non-stretchable material 16 to have a one-fourth inch end portion folded thereunder prior to attachment to stretchable material 10, or prior to attachment to itself after being inserted through connecting bracket 8, so as to conceal raw edges (not shown) which may fray with use if exposed and provide a more stable and long-lasting attachment. Also, although not critical, in the preferred embodiment it is contemplated for pile portions 6 to be approximately three inches in length, and for hook portions 7 to be approximately three-fourths inches in length. However, the afore-mentioned lengths may be lengthened or shortened as needed to fit different sizes of garments (not shown). It is not contemplated for shoulder strap support invention 2 to be used with garments having neck straps (not shown), such as halter tops and brassieres for use with halter tops. Nor is it contemplated for shoulder strap support invention 2 to be used with sports brassieres (not shown) which already have means to bias opposed shoulder straps toward one another. Although not shown, it is contemplated for shoulder strap support invention 2 to be made in many sizes and in many colors to be used with garments of differing styles and design. Also, in the preferred embodiment, it is contemplated for shoulder strap support invention 2 to be releasably attached to an article of clothing having back fastening means, as in FIG. 1, or to have one end of shoulder strap support invention 2 releasably attached to one shoulder strap 4 and the other end of shoulder strap support invention 2 permanently attached to the other shoulder strap 4, as in FIG. 2. In contrast, for articles of clothing having front fastening means, as in FIG. 3, it is contemplated for shoulder strap support invention 2 to be permanently attached to each shoulder strap 4.

What is claimed is:

1. A shoulder strap support device for use with articles of clothing which have opposed shoulder straps while they are being worn, said device being connected to each of the opposed shoulder straps so as to be positioned between them to keep the shoulder straps in a substantially vertical position during use, said support device comprising at least one length of stretchable material having opposite ends, lengthwise adjusting means connected to said stretchable material and dated so that said stretchable material can be lengthened and shortened during use by the person using it, and fastening means connected to each of said opposite ends and adapted for securely fastening said stretchable material between the opposed shoulder straps so that opposed shoulder straps remain biased toward one another during use, said fastening means also adapted for releasably attaching one of said opposite ends of said stretchable material to one of the opposed shoulder straps and permanently attaching the other of said opposite ends of said stretchable material to the other one of the opposed shoulder straps on the same article of clothing, and wherein said fastening means comprise a length of non-stretchable material having a first end and a second end, a plurality of hook and pile type of fasteners each having a hooked portion and a pile portion, a connecting bracket having an opening therethrough, and stitching means, one of said opposite ends of said stretchable material being permanently attached to one of the opposed shoulder straps, the other of said opposite ends of said stretchable material each being inserted through said opening in said connecting bracket and connected to itself by said stitching means, said first end of said non-stretchable material also being inserted through said opening in said connecting bracket and connected to itself near to said connecting bracket by said stitching means, at least one of said hooked portions being attached by said stitching means to said second end of said non-stretchable material, each of said pile portions being attached by said stitching means to said non-stretchable material in a position near to one of said hooked portions and between said hooked portions and said connecting bracket so that when said second end of said non-stretchable material is looped around the other one of the opposed shoulder straps and said hooked portions attached to said second end are engaged with said adjacent pile portions said support device becomes releasably attached to the other one of the opposed shoulder straps.

2. The support device of claim 1 wherein said lengthwise adjusting means comprises an adjusting bracket having two adjacent apertures, one of said opposite ends of said stretchable material being inserted through both of said apertures, inserted through said opening in said connecting bracket, looped around said adjusting bracket prior to being inserted a second time through both of said apertures in said adjusting bracket in a same direction as said first insertion, and said stretchable material finally secured to itself close thereby to said adjusting bracket so that said stretchable material remains movable through both of said apertures in said adjusting bracket and a portion of said stretchable material is positioned behind the remainder of said stretchable material for use in lengthening said stretchable material between the opposed shoulder straps.

3. The support device of claim 1 wherein said support device is permanently attached to both of the opposed shoulder straps.

4. The support device of claim 1 wherein said support device comprises a first length of stretchable material and a second length of stretchable material, each of said lengths of stretchable material having opposite ends, and wherein said fastening means comprise a connecting bracket having an opening therethrough and stitching means, one of said opposite ends of said first length of said stretchable material being permanently attached to one of the opposed shoulder straps, one of said opposite ends of said second length of said stretchable material being permanently attached to the other one of the shoulder straps, the other of said opposite ends of each of said lengths of stretchable material being inserted through said opening in said connecting bracket and connected to itself by said stitching means.

5. The support device of claim 4 wherein said lengthwise adjusting means comprises an adjusting bracket having two adjacent apertures, one of said opposite ends of one of said lengths of said stretchable material being positioned so as to be inserted through both of said apertures, inserted through said opening in said connecting bracket, looped around said adjusting bracket prior to being inserted a second time through both of said apertures in said adjusting bracket in a same direction as said first insertion, and secured to itself close to said adjusting bracket wherein said stretchable material remains movable through both of said apertures in said adjusting bracket and a portion of said stretchable material is positioned behind the remainder of said stretchable material for use in lengthening said stretchable material between the opposed shoulder straps.

6. A support device for use with articles of clothing which have opposed shoulder straps while they are being worn, said device being connected to each of the opposed shoulder straps so as to be positioned between them to keep the shoulder straps in a substantially vertical position during use, said support device comprising at least one length of stretchable material having opposite ends, lengthwise adjusting means comprising an adjusting bracket having two adjacent apertures therethrough and a first connecting bracket with an opening therethrough, one of said opposite ends of said stretchable material being inserted through both of said apertures, inserted through said opening in said first connecting bracket, looped around said adjusting bracket prior to being inserted a second time through both of said apertures in said adjusting bracket in a same direction as said first insertion, and said stretchable material finally secured to itself close thereby to said adjusting bracket so that said stretchable material remains movable through both of said apertures in said adjusting bracket and a portion of said stretchable material is positioned behind the remainder of said stretchable material for use by the person wearing said support device in lengthening said stretchable material between the opposed shoulder straps without assistance from another person, and fastening means connected to each of said opposite ends to securely fasten said stretchable material between the opposed shoulder straps so that the opposed shoulder straps will remain biased toward one another during use, said fastening means releasably attaching said first connecting bracket to one of the opposed shoulder straps and permanently attaching the other of said opposite ends of said stretchable material to the other of the opposed shoulder straps.

7. The support device of claim 6 wherein said fastening means comprise a length of non-stretchable material having a first end and a second end, a plurality of hook and pile type of fasteners each having a hooked portion and a pile portion, and stitching means, the other of said opposite ends of said stretchable material being permanently attached to one of the opposed shoulder straps, said first end of said non-stretchable material being inserted through said opening in said first connecting bracket and connected to itself near to said first connecting bracket by said stitching means, at least one of said hooked portions being attached by said stitching means to said second end of said non-stretchable material, each of said pile portions being attached by said stitching means to said non-stretchable material in a position near to one of said hooked portions and between said hooked portions and said first connecting bracket so that when said second end of said non-stretchable material is looped around the other of the opposed shoulder straps and said hooked portions attached to said second end are engaged with said adjacent pile portions said support device becomes releasably attached to the other of the opposed shoulder straps.

8. The support device of claim 6 wherein said support device is permanently attached to both of the opposed shoulder straps.

9. The support device of claim 8 wherein said support device comprises a first length of stretchable material and a second length of stretchable material, each of said lengths of stretchable material having opposite ends, and wherein said fastening means comprise said second length of stretchable material and stitching means, one of said opposite ends of said first length of said stretchable material being permanently attached to one of the opposed shoulder straps, one of said opposite ends of said second length of said stretchable material being permanently attached to the other of the opposed shoulder straps, the other of said opposite ends of each of said lengths of stretchable material being inserted through said opening in said first connecting bracket and connected to itself by said stitching means.

* * * * *